US006679752B1

(12) United States Patent
Reed, Sr.

(10) Patent No.: US 6,679,752 B1
(45) Date of Patent: Jan. 20, 2004

(54) REMOTE CONTROLLABLE TOY DEVICE AND METHOD OF USING

(76) Inventor: Rodrick L. Reed, Sr., 1538 W. 11th St., San Bernardino, CA (US) 92411

( * ) Notice: Subject to any disclaimer, the term of this patent is extended or adjusted under 35 U.S.C. 154(b) by 0 days.

(21) Appl. No.: 10/441,305

(22) Filed: May 15, 2003

(51) Int. Cl.[7] ..... A63H 17/26
(52) U.S. Cl. ..... 446/437; 446/454
(58) Field of Search ..... 446/431, 437, 446/454, 456, 448, 446, 427

(56) References Cited

U.S. PATENT DOCUMENTS 5,322,469 A * 6/1994 Tilbor ..... 446/454
5,785,576 A * 7/1998 Belton ..... 446/456
6,015,330 A * 1/2000 Simmons et al. ..... 446/437
6,565,409 B1 * 5/2003 Isogai ..... 446/437
6,565,412 B1 * 5/2003 Thrasher ..... 446/465

* cited by examiner

*Primary Examiner*—Jacob K. Ackun

(57) ABSTRACT

A new and improved remote controllable toy device and an associated method of using are disclosed. The remote controllable toy device includes a radio transmitter unit and a toy car responsive to the radio transmitter unit. The radio transmitter unit having a housing, an antenna, a first battery, a transmitter circuit, a propulsion switch, a steering switch, a front end hopping switch, a four wheel lifting switch, and an on/off switch. The toy car having an upper shell, an undercarriage attachable to the upper shell, in which the undercarriage has a receiver, a control unit, a motor, a gear set, a plurality of wheels, and a means for hopping, a means for lifting all four wheels, and a means for oscillating up and down after hopping. The method includes the steps of activating, bending, depressing, detaching, lifting, manipulating, obtaining, picking, placing, pressing, pushing, reattaching, releasing, toggling, and touching.

20 Claims, 5 Drawing Sheets

10

28
20
12
16
22
26
30
24
66
70
72
76
74
78
68
32
60
64
52
82
64
62
50

REMOTE CONTROLLABLE TOY DEVICE AND METHOD OF USING

FIELD OF THE INVENTION

The present invention relates to toys, more particularly to a remote controllable toy device for use in connection simulating the type of vertical car movements associated with "low riders"

DESCRIPTION OF THE PRIOR ART

Vehicle toys are well know. Remotely controlled, in particular, radio-controlled vehicles have come to constitute a significant specialty toy market.

Manufacturers in the market attempt to duplicate well known vehicles, as well as, providing means for simulating these vehicles movements. A wide variety of toy vehicle devices is currently available on the commercial market and an even larger number of these types of devices are known in the art of toy vehicle devices, for example, the toy car chassis intermittent tilt and steering structure disclosed by Cao-Chin and Kuo-Heng in U.S. Pat. No. 5,019,009; the vehicle toy with elevating body disclosed by Tilbor in U.S. Pat. No. 5,322,469; the remote control toy vehicle with driven jumper disclosed by Simone, Siegfried, and Rodmaker in U.S. Pat. No. 5,618,219; the toy automobile disclosed by Hollis and Stahl in U.S. Pat. No. D167,888; the model car disclosed by Vendetti in U.S. Pat. No. D305,250; and the remote control model car disclosed by Novak in U.S. Pat. No. D366,296.

While all of the above-described devices fulfill their respective, particular objectives and requirements, the aforementioned patents do not describe a remote controllable toy device having a radio transmitter unit and a toy car responsive to the radio transmitter unit, in which the radio transmitter unit has a housing, an antenna, a first battery, a transmitter circuit, a propulsion switch, a steering switch, a front end hopping switch, a four wheel lifting switch, and an on/off switch. This combination of elements would specifically match the user's particular individual needs of making it possible to play with the toy device as if it were a real "low rider" car by allowing the user a means for front end hopping the car with the front wheels, a means for oscillating the car in a rocking up and down manner, and a means for lifting the car upwards with all four wheels. The above-described patents make no provision for a remote controllable toy device having a radio transmitter unit and a toy car responsive to the radio transmitter unit, in which the radio transmitter unit has a housing, an antenna, a first battery, a transmitter circuit, a propulsion switch, a steering switch, a front end hopping switch, a four wheel lifting switch, and an on/off switch.

Therefore, a need exists for a new and improved remote controllable toy device having a radio transmitter unit and a toy car responsive to the radio transmitter unit, in which the radio transmitter unit has a housing, an antenna, a first battery, a transmitter circuit, a propulsion switch, a steering switch, a front end hopping switch, a four wheel lifting switch, and an on/off switch. In this respect, the remote controllable toy device according to the present invention substantially departs from the conventional concepts and designs of the prior art, and in doing so provides an apparatus primarily developed for the purpose of providing a user a toy device which mimics a real "low rider" car by allowing the user a means for front end hopping the car with the front wheels, a means for oscillating the car in a rocking up and down manner, and a means for lifting the car upwards with all four wheels.

SUMMARY OF THE INVENTION

The present device and method of using the device, according to the principles of the present invention, overcomes the shortcomings of the prior art by providing a remote controllable toy device and an associate method of using the device. The remote controllable toy device comprises a radio transmitter unit and a toy car responsive to the radio transmitter unit. The radio transmitter unit having a housing, an antenna, a first battery, a transmitter circuit, a propulsion switch, a steering switch, a front end hopping switch, a four wheel lifting switch, and an on/off switch. The toy car having an upper shell, an undercarriage attachable to the upper shell, in which the undercarriage has a receiver, a control unit, a motor, a gear set, a plurality of wheels, and a means for hopping, a means for lifting all four wheels, and a means for oscillating up and down after hopping. The method comprises the steps of activating, bending, depressing, detaching, lifting, manipulating, obtaining, picking, placing, pressing, pushing, reattaching, releasing, toggling, and touching.

In view of the foregoing disadvantages inherent in the known type remote controllable toy devices now present in the prior art, the present invention provides an improved remote controllable toy device, which will be described subsequently in great detail, is to provide a new and improved remote controllable toy device which is not anticipated, rendered obvious, suggested, or even implied by the prior art, either alone or in any combination thereof.

To attain this, the present invention essentially comprises a radio transmitter unit and a toy car responsive to the radio transmitter unit. The radio transmitter unit having a housing, an antenna, a first battery, a transmitter circuit, a propulsion switch, a steering switch, a front end hopping switch, a four wheel lifting switch, and an on/off switch. The toy car having an upper shell, an undercarriage attachable to the upper shell, in which the undercarriage has a receiver, a control unit, a motor, a gear set, a plurality of wheels, and a means for hopping, a means for lifting all four wheels, and a means for oscillating up and down after hopping.

There has thus been outlined, rather broadly, the more important features of the invention in order that the detailed description thereof that follows may be better understood, and in order that the present contribution of the art may be better appreciated.

The invention may also include detachable hubcaps. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments aid of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved remote controllable toy device that has all the advantages of the prior art remote controllable toy device and none of the disadvantages.

It is another object of the present invention to provide a new and improved remote controllable toy device that may be easily and efficiently manufactured and marketed.

An ever further object of the present invention is to provide a new and improved remote controllable toy device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new remote controllable toy device that provides in the apparatuses and methods of the prior art some of the advantages thererof, while simultaneously overcoming some of the disadvantages normally associated therewith.

Even still another object of the present invention is to provide a remote controllable toy device having a radio transmitter unit and a toy car responsive to the radio transmitter unit, in which the radio transmitter unit has a housing, an antenna, a first battery, a transmitter circuit, a propulsion switch, a steering switch, a front end hopping switch, a four wheel lifting switch, and an on/off switch. This combination of elements makes it possible to play with the toy device as if it were a real "low rider" car by allowing the user a means for front end hopping the car with the front wheels, a means for oscillating the car in a rocking up and down manner, and a means for lifting the car upwards with all four wheels.

Lastly, it is an object of the present invention to provide a new and improved method of using comprising the steps of activating, bending, depressing, detaching, lifting, manipulating, obtaining, picking, placing, pressing, pushing, reattaching, releasing, toggling, and touching.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and object is other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
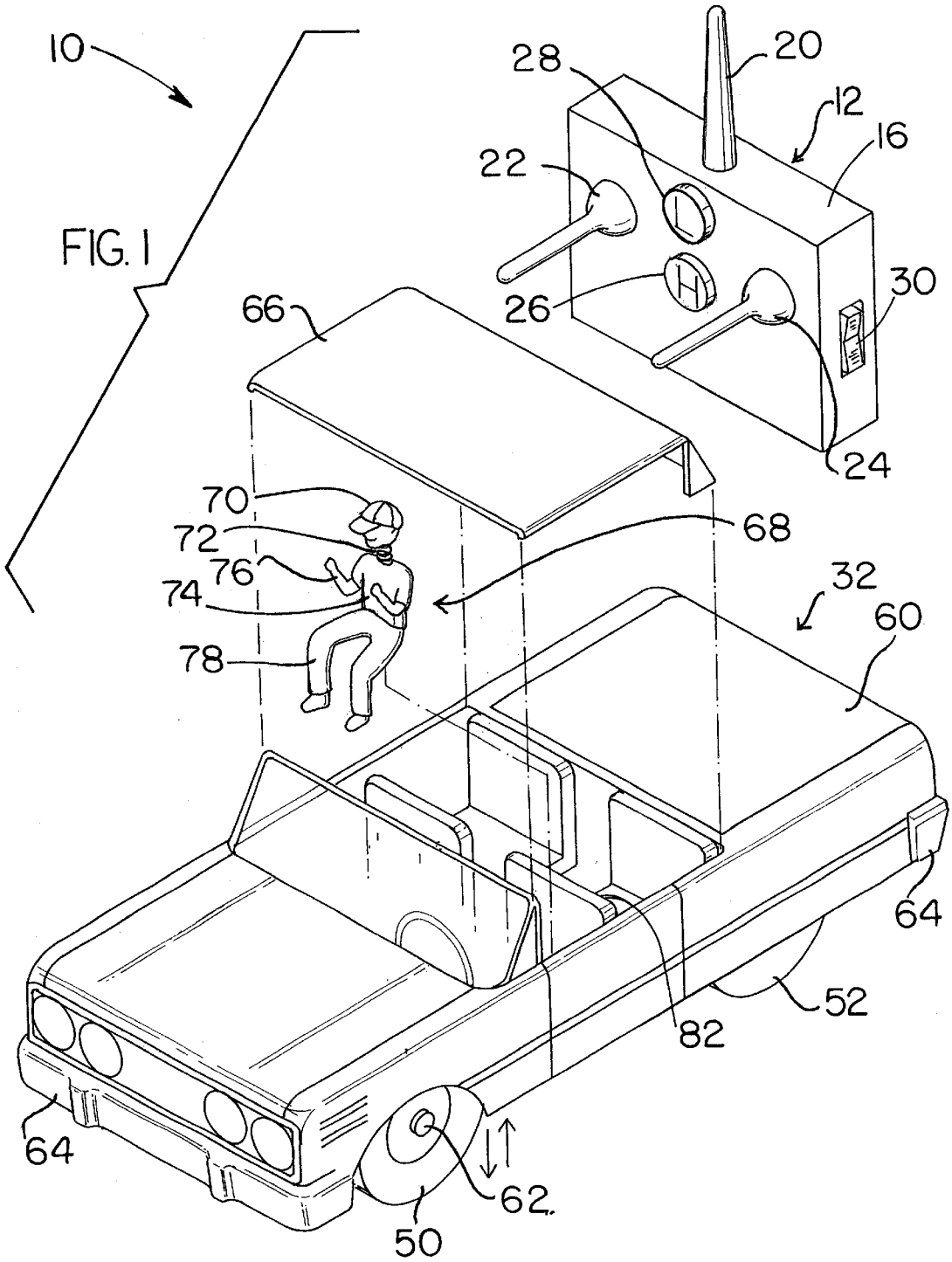
FIG. 1 is a front perspective view of a preferred embodiment of the remote controllable toy device constructed in accordance with the principles of the present invention.

Referring now to the drawings, and in particular FIGS. 1 to 5 thereof, one preferred embodiment of the present invention is shown and generally designated by the reference numeral 10. One preferred embodiment of remote controllable toy device 10 comprises: a radio transmitter unit 12 including: a housing 14; a first battery 16 attached to the housing 14; a transmitter circuit 18 attached to the housing 14, the transmitter circuit 18 is operationally attached to the first battery 16; an antenna 20 attached to the housing 14, the antenna 20 is operationally attached to the transmitter circuit 18; a propulsion switch 22 attached to the housing 14, the propulsion switch 22 is operationally attached to the transmitter circuit 18; a steering switch 24 attached to the housing 14, the steering switch 24 is operationally attached to the transmitter circuit 18; a front end hopping switch 26, the front end hopping switch 26 is operationally attached to the transmitter circuit 18; a four wheel lifting switch 28, the four wheel lifting switch 28 is operationally attached to the transmitter circuit 18; and an on/off switch 30 attached to the housing 14, the on/off switch 30 is operationally attached to the transmitter circuit 18; and a toy car 32 including: an undercarriage 34 having at least one seat 82; a second battery 36 attached to the undercarriage 34; a control unit 38 attached to the undercarriage 34, the control unit 38 operatively connected to the second battery 36; a receiver 40 attached to the undercarriage 34, the receiver 40 is operatively connected to the control unit 38, wherein the receiver 40 is operationally connectable to the transmitter circuit 18 of the radio transmitter unit 12; a motor 42 attached to the undercarriage 34, the motor 42 is operatively connected to the control unit 38; a gear set 44 attached to the undercarriage 34, the gear set 44 is operatively connected to the control unit 38, wherein the gear set 44 for propelling and steering the toy car 32; a pair of rear axles 46 pivotally attached to the undercarriage 34; a pair of front axles 48 pivotally attached to the undercarriage 34; a pair of front wheels 50 rotatably attached to the pair of front axles 48, at least one front wheel of the pair of front wheels 50 is operationally connected to the gear set 44; a pair of rear wheels 52 rotatably attached to the pair of rear axles 46, at least one rear wheel of the pair of rear wheels 52 is operationally connected to the gear set 44; a pair of front solenoids 54 attached to the undercarriage 34 and attached to the pair of front axles 48, the pair of front solenoids 54 is operationally connected to the control unit 38; at least one front shock spring 56 attached to the undercarriage 34 and attached to one of the pair of front axles 48; a pair of rear solenoids 58 attached to the undercarriage 34 and attached to the pair of rear axles 46, the pair of rear solenoids 58 is operationally connected to the control unit 38; and an upper shell 60 attached to the undercarriage 34 wherein the upper shell having at least one seat 82.

An optional set of four hubcaps 62 may be added to the device 10 in which the four hubcaps 62 attach the front and rear wheels 52 to the front and rear axles 46 plurality of wheel caps, respectively, wherein each hubcap 62 is releasably attached to the undercarriage 34 of the toy car 32.

An optional pair of bumpers 64 may be added to the device 10 in which the pair of bumpers 64 is attached to the undercarriage 34 of the toy car 32.

An optional cab top 66 may be added to the device 10 in which the cab top 66 is detachably attached to the upper shell 60 of the toy car 32.

An optional toy driver doll 68 may be added to the device 10 in which the toy driver doll 68 may comprise a head 70; a neck 72 attached to the head 70; a torso 74 attached to the neck 72; a pair of arms 76 attached to the torso 74; and a pair of legs 78 attached to the torso 74. The neck 72 of the toy driver doll 68 may comprise a coil spring. The toy driver doll 68 may further comprise a lock pin 80 positioned at the bottom of the torso 74. The pair of arms 76 of the toy driver doll 68 may be pivotally attached to the torso 74 of the toy driver doll 68. The pair of legs 78 of the toy driver doll 68 may also be pivotally attached to the torso 74 of the toy driver doll 68.

The batteries may be any commercially available batteries, wherein the first battery 16 may be rechargeable. The second battery 36 may also be rechargeable.

The upper shell 60 may be shaped and designed to have any commercially available automobile shape and design. One preferred configuration of the upper shell 60 is that it is designed to appear as an automobile design selected from: the group consisting of a 1963 Chevrolet Impala, a 1964 Chevrolet Impala, a 1985 Oldsmobile Cutlass, a 1985 Regal, and a 1983 Cadillac Coupe De'Ville. The upper shell 60 may be detachably attached to the undercarriage 34.

The front end hopping switch 26 is configured to be capable of enabling the transmitting circuit to transmit a first radio signal in which the toy car 32 is capable of responding to the transmitted first radio signal by activating the pair of front solenoids 54 to extend lengthwise whereby allowing the undercarriage 34 relative to the pair of front wheels 50 to be elevated into a front end raised position, wherein the front end hopping switch 26 is capable of enabling the transmitting circuit to terminate the transmission of the first radio signal in which the toy car 32 in the front end raised position is capable of responding to the termination of the transmission of the first radio signal by activating the pair of front solenoids 54 to contract lengthwise whereby allowing the undercarriage 34 relative to the pair of front wheels 50 to be lowered, wherein when the undercarriage 34 relative to the pair of front wheels 50 is lowered then the at least one front shock spring 56 is capable of oscillating the undercarriage 34 upwardly and downwardly.

The four wheel lifting switch 28 is configured to be capable of enabling the transmitting circuit to transmit a second radio signal in which the toy car 32 is capable of responding to the transmitted second radio signal by activating the pair of front solenoids 54 and the pair of rear solenoids 58 to extend themselves whereby allowing the undercarriage 34 relative to the pair of front wheels 50 and the pair of rear wheels 52 to be elevated into a four wheel lifted position, wherein the four wheel lifting switch 28 is capable of enabling the transmitting circuit to terminate the transmission of the second radio signal in which the toy car 32 in the four wheel lifted position is capable of responding to the termination of the transmission of the second radio signal by activating the pair of front solenoids 54 and the pair of rear solenoids 58 to distend themselves whereby allowing the undercarriage 34 relative to the pair of front wheels 50 and the pair of rear wheels 52 to be lowered.

The propulsion switch 22 is configured to be capable of enabling the transmitting circuit to transmit a third radio signal in which the toy car 32 is capable of responding to the transmitted third radio signal by activating the gear set 44 to rotationally move at least one wheel of the pair of rear wheels 52 to propel the toy car 32.

The steering switch 24 is configured to be capable of enabling the transmitting circuit to transmit a fourth radio signal in which the toy car 32 is capable of responding to the transmitted fourth radio signal by activating the gear set 44 to turn at least one wheel of the pair of front wheels 50 to steer the toy car 32.

Another preferred embodiment of the device 10 consists essentially of: a radio transmitter unit 12 including: a housing 14; a first battery 16 attached to the housing 14; a transmitter circuit 18 attached to the housing 14, the transmitter circuit 18 is operationally attached to the first battery 16; an antenna 20 attached to the housing 14, the antenna 20 is operationally attached to the transmitter circuit 18; a propulsion switch 22 attached to the housing 14, the propulsion switch 22 is operationally attached to the transmitter circuit 18; a steering switch 24 attached to the housing 14, the steering switch 24 is operationally attached to the transmitter circuit 18; a front end hopping switch 26, the front end hopping switch 26 is operationally attached to the transmitter circuit 18; a four wheel lifting switch 28, the four wheel lifting switch 28 is operationally attached to the transmitter circuit 18; and an on/off switch 30 attached to the housing 14, the on/off switch 30 is operationally attached to the transmitter circuit 18; a toy car 32 including: an undercarriage 34; a second battery 36 attached to the undercarriage 34; a control unit 38 attached to the undercarriage 34, the control unit 38 operatively connected to the second battery 36; a receiver 40 attached to the undercarriage 34, the receiver 40 is operatively connected to the control unit 38, wherein the receiver 40 is operationally connectable to the transmitter circuit 18 of the radio transmitter unit 12; a motor 42 attached to the undercarriage 34, the motor 42 is operatively connected to the control unit 38; a gear set 44 attached to the undercarriage 34, the gear set 44 is operatively connected to the control unit 38, wherein the gear set 44 for propelling and steering the toy car 32; a pair of rear axles 46 pivotally attached to the undercarriage 34; a pair of front axles 48 pivotally attached to the undercarriage 34; a pair of front wheels 50 rotatably attached to the pair of front axles 48, at least one front wheel of the pair of front wheels 50 is operationally connected to the gear set 44; a pair of rear wheels 52 rotatably attached to the pair of rear axles 46, at least one rear wheel of the pair of rear wheels 52 is operationally connected to the gear set 44; a pair of front solenoids 54 attached to the undercarriage 34 and attached to the pair of front axles 48, the pair of front solenoids 54 is operationally connected to the control unit 38; at least one front shock spring 56 attached to the undercarriage 34 and attached to one of the pair of front axles 48; Sa pair of rear solenoids 58 attached to the undercarriage 34 and attached to the pair of rear axles 46, the pair of rear solenoids 58 is operationally connected to the control unit 38; an upper shell 60 attached to the undercarriage 34 wherein the upper shell having at least one seat 82; four hubcaps 62 attaching the front and rear wheels 52 to the front and rear axles 46 plurality of wheel caps, each hubcap 62 is releasably attached to the undercarriage 34 of the toy car 32; and a pair of bumpers 64 attached to the undercarriage 34 of the toy car 32; a cab top 66 detachably attached to the upper shell 60 of the toy car 32; and a toy driver doll 68 including: a head 70; a neck 72 attached to the head 70 wherein the neck 72 of the toy driver doll 68 comprises a coil spring; a torso 74 attached to the neck 72; a pair of arms 76 attached to the torso 74 wherein the pair of arms 76 of the toy driver doll 68 is pivotally attached to the torso 74 of the toy driver doll 68; and a pair of legs 78 attached to the torso 74 wherein the pair of legs 78 of the toy driver doll 68 is pivotally attached to the torso 74 of the toy driver doll 68.

One preferred embodiment of a method of using a remote controllable toy device 10, the method comprising the steps of activating, bending, depressing, detaching, lifting, manipulating, obtaining, picking, placing, pressing, pushing, reattaching, releasing, toggling, and touching. The obtaining step comprises obtaining the device 10 comprising: a radio transmitter unit 12 including: a housing 14; a first battery 16 attached to the housing 14; a transmitter circuit 18 attached to the housing 14, the transmitter circuit 18 is operationally attached to the first battery 16; an antenna 20 attached to the housing 14, the antenna 20 is operationally attached to the transmitter circuit 18; a propulsion switch 22 attached to the housing 14, the propulsion switch 22 is operationally attached to the transmitter circuit 18; a steering switch 24 attached to the housing 14, the steering switch 24 is operationally attached to the transmitter circuit 18; a front end hopping switch 26, the front end hopping switch 26 is operationally attached to the transmitter circuit 18; a four wheel lifting switch 28, the four wheel lifting switch 28 is operationally attached to the transmitter circuit 18; and an on/off switch 30 attached to the housing 14, the on/off switch 30 is operationally attached to the transmitter circuit 18; a toy car 32 including: an undercarriage 34; a second battery 36 attached to the undercarriage 34; a control unit 38 attached to the undercarriage 34, the control unit 38 operatively connected to the second battery 36; a receiver 40 attached to the undercarriage 34, the receiver 40 is operatively connected to the control unit 38, wherein the receiver 40 is operationally connectable to the transmitter circuit 18 of the radio transmitter unit 12; a motor 42 attached to the undercarriage 34, the motor 42 is operatively connected to the control unit 38; a gear set 44 attached to the undercarriage 34, the gear set 44 is operatively connected to the control unit 38, wherein the gear set 44 for propelling and steering the toy car 32; a pair of rear axles 46 pivotally attached to the undercarriage 34; a pair of front axles 48 pivotally attached to the undercarriage 34; a pair of front wheels 50 rotatably attached to the pair of front axles 48, at least one front wheel of the pair of front wheels 50 is operationally connected to the gear set 44; a pair of rear wheels 52 rotatably attached to the pair of rear axles 46, at least one rear wheel of the pair of rear wheels 52 is operationally connected to the gear set 44; a pair of front solenoids 54 attached to the undercarriage 34 and attached to the pair of front axles 48, the pair of front solenoids 54 is operationally connected to the control unit 38; at least one front shock spring 56 attached to the undercarriage 34 and attached to one of the pair of front axles 48; a pair of rear solenoids 58 attached to the undercarriage 34 and attached to the pair of rear axles 46, the pair of rear solenoids 58 is operationally connected to the control unit 38; an upper shell 60 attached to the undercarriage 34 wherein the upper shell having at least one seat 82; four hubcaps 62 attaching the front and rear wheels 52 to the front and rear axles 46 plurality of wheel caps, each hubcap 62 is releasably attached to the undercarriage 34 of the toy car 32; and a pair of bumpers 64 attached to the undercarriage 34 of the toy car 32; a cab top 66 detachably attached to the upper shell 60 of the toy car 32; and a toy driver doll 68 including: a head 70; a neck 72 attached to the head 70 wherein the neck 72 of the toy driver doll 68 comprises a coil spring; a torso 74 attached to the neck 72; a pair of arms 76 attached to the torso 74 wherein the pair of arms 76 of the toy driver doll 68 is pivotally attached to the torso 74 of the toy driver doll 68; and a pair of legs 78 attached to the torso 74 wherein the pair of legs 78 of the toy driver doll 68 is pivotally attached to the torso 74 of the toy driver doll 68. The detaching step comprises detaching the cab top 66 from the upper shell 60 of the toy car 32. The lifting step comprises lifting up the cab top 66 from the upper shell 60 of the toy car 32. The bending step comprises bending the arms 76 and the legs 78 of the toy driver doll 68 to fit within the seat 82 in the toy car 32. The placing step comprises placing the bent toy driver doll 68 onto the seat 82 in the toy car 32. The reattaching step comprises reattaching the cab top 66 onto the upper shell 60 of the toy car 32. The picking step comprises picking up the radio transmitter unit 12. The activating step comprises activating the radio transmitter unit 12 by switching on the on/off switch 30. The pressing step comprises pressing onto the front end hopping switch 26 of the radio transmitter unit 12 wherein the toy car 32 elevates to a front end raised position. The depressing step comprises depressing onto the front end hopping switch 26 of the radio transmitter unit 12 when the toy car 32 is in the front end raised position wherein enabling the pair of front solenoids 54 to contract lengthwise whereby allowing the undercarriage 34 relative to the pair of front wheels 50 to be lowered, whereby allowing the undercarriage 34 to oscillate upwardly and downwardly. The pushing step comprises pushing onto the the four wheel lifting switch 28 of the radio transmitter unit 12 wherein the toy car 32 elevates into a four wheel lifted position. The releasing step comprises releasing the four wheel lifting switch 28 of the radio transmitter unit 12 whereby allowing the undercarriage 34 relative to the pair of front wheels 50 and the pair of rear wheels 52 to be lowered. The toggling step comprises toggling the propulsion switch 22 of the radio transmitter unit 12, wherein allowing the toy car 32 to be propelled forward relative to the pair of front axles 48. The touching step comprises touching the propulsion switch 22 of the radio transmitter unit 12, wherein allowing the toy car 32 to be propelled backwards relative to the pair of front axles 48. The manipulating step comprises manipulating the steering switch 24 of the radio transmitter unit 12, wherein allowing the toy car 32 to be turned.

Another preferred embodiment of a method consists essentially of the steps of activating, bending, depressing, detaching, lifting, manipulating, obtaining, picking, placing, pressing, pushing, reattaching, releasing, toggling, and touching.

Referring now to FIG. 1 which depicts a front perspective view of a preferred embodiment of the remote controllable toy device 10 showing a radio transmitter unit 12 having a housing 14; an antenna 20; a propulsion switch 22; a steering switch 24; a front end hopping switch 26; a four wheel lifting switch 28; and an on/off switch 30. Also shown is a toy car 32 including: an undercarriage 34; a front wheel 50; a rear wheel 52; and an upper shell 60. Also shown are hubcaps 62, a pair of bumpers 64, and a cab top 66. The optional toy driver doll 68 is also shown having a head 70; a neck 72; a torso 74; a pair of arms 76; and a pair of legs 78.

Figure 2:
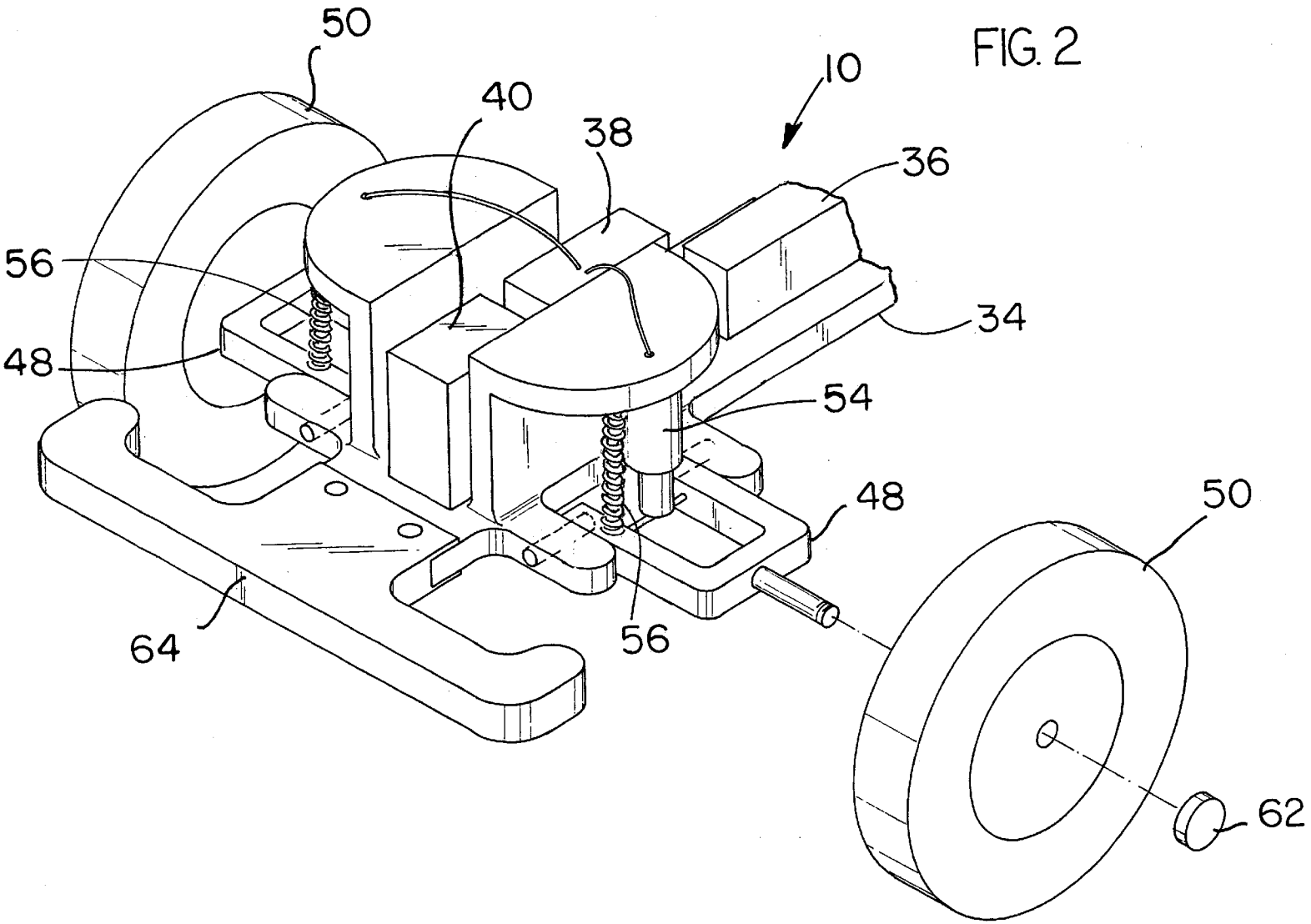
FIG. 2 is a perspective view of a front end of a preferred embodiment of the remote controllable toy device of the present invention.

Referring now to FIG. 2 is a perspective view of a front end of a preferred embodiment of the remote controllable toy device 10 showing an undercarriage 34; a second battery 36; a control unit 38; a receiver 40; a pair of front axles 48; a pair of front wheels 50; a front solenoid 54; a pair of front shock springs 56; and a bumper 64.

Figure 3:
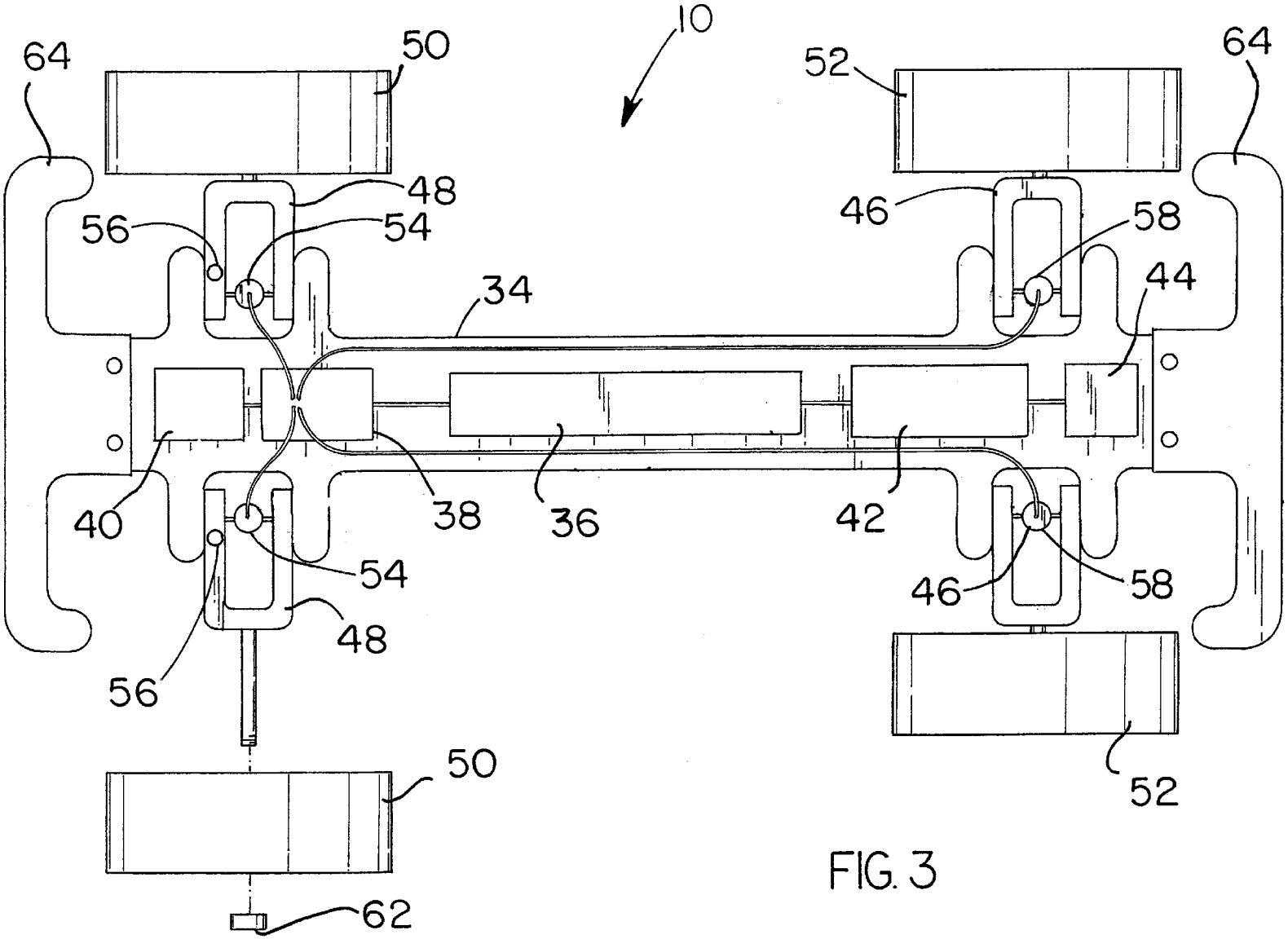
FIG. 3 is a top view of a preferred embodiment of the remote controllable toy device of the present invention.

Referring now to FIG. 3 is a top view of a preferred embodiment of the remote controllable toy device 10 showing an undercarriage 34; a control unit 38; a receiver 40; a motor 42; a gear set 44; a pair of rear axles 46; a pair of front axles 48; a pair of front wheels 50; a pair of rear wheels 52; a pair of front solenoids 54; a pair of front shock spring 56; a pair of rear solenoids 58; a pair of bumpers 64, and a hubcap 62.

Figure 4:
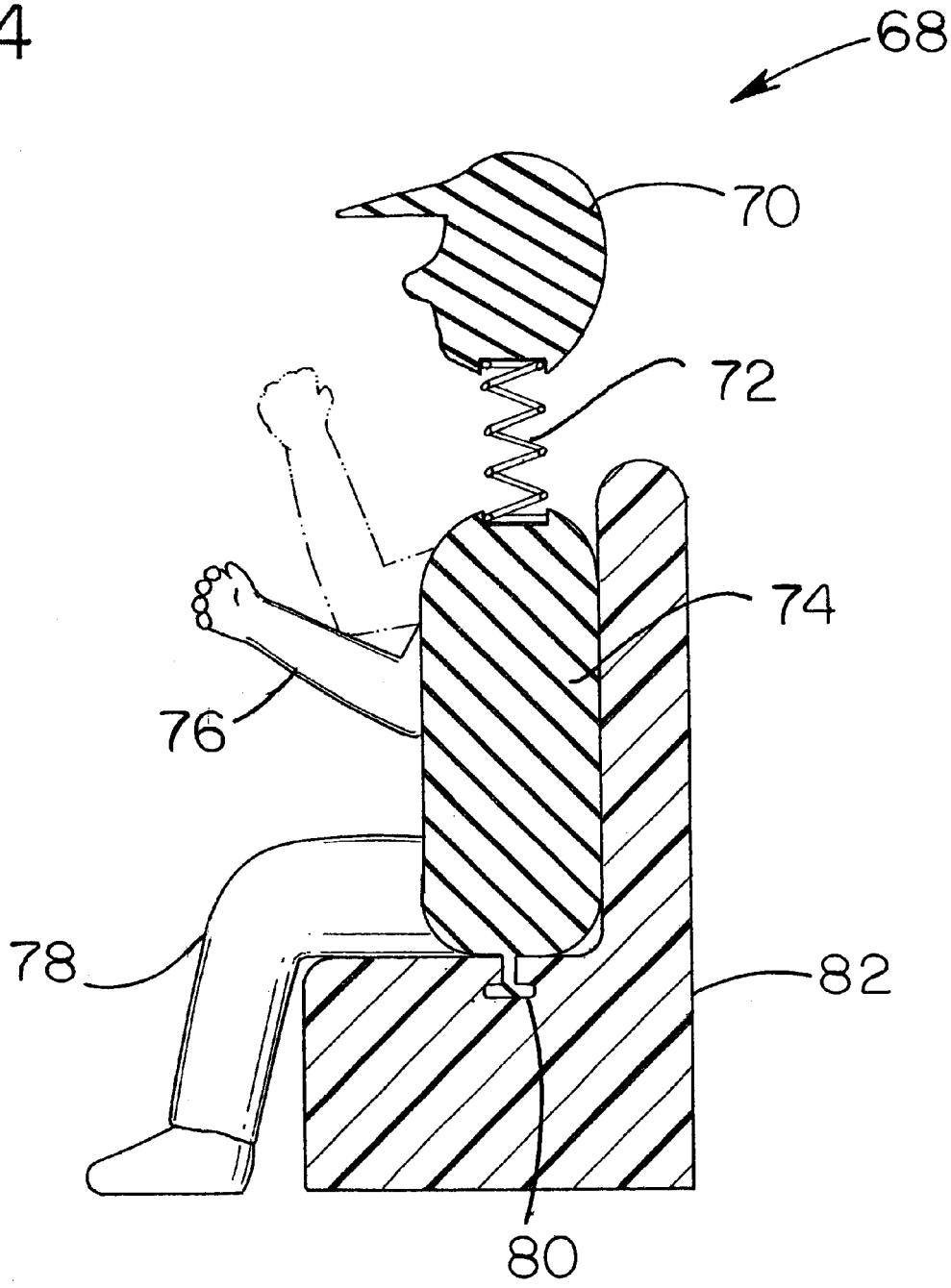
FIG. 4 is a cross sectional view of a toy driver doll of a preferred embodiment of the the remote controllable toy device of the present invention.

Referring now to FIG. 4 is a cross sectional view of a toy driver doll of a preferred embodiment of the the remote controllable toy device 10 showing the toy driver doll 68 seated on a seat 82 in which the toy driver doll 68 is shown having a head 70; a neck 72; a torso 74; a pair of arms 76 and a pair of legs 78 and a lock pin 80 positioned at the bottom of the torso 74.

Figure 5:
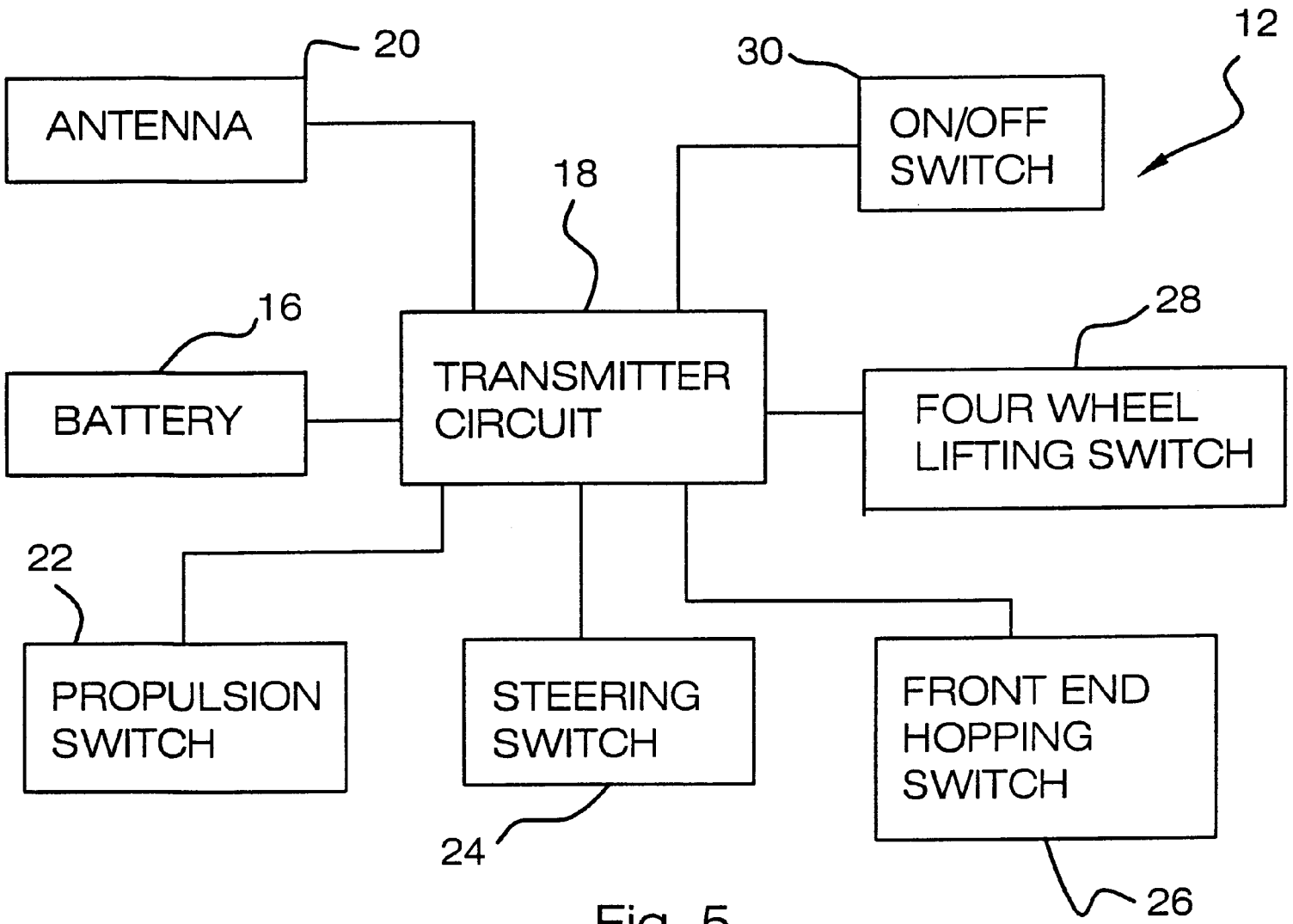
FIG. 5 is a schematic plan view of the transmitter unit of a preferred embodiment of the remote controllable toy device of the present invention.

Referring now to FIG. 5 is a schematic plan view of the transmitter unit 12 of a preferred embodiment of the remote controllable toy device 10 showing a first battery 16; an antenna 20; a propulsion switch 22; a steering switch 24; a front end hopping switch 26, a four wheel lifting switch 28; and an on/off switch 30.

As to the manner of usage and operation of the present invention, the same should be apparent from the above description. Accordingly, no further discussion relating to the manner of usage and operation will be provided.

While a preferred embodiment of the remote controllable toy device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A remote controllable toy device comprising:

a radio transmitter unit including:

a housing;

a first battery attached to said housing;

a transmitter circuit attached to said housing, said transmitter circuit is operationally attached to said first battery;

an antenna attached to said housing, said antenna is operationally attached to said transmitter circuit;

a propulsion switch attached to said housing, said propulsion switch is operationally attached to said transmitter circuit;

a steering switch attached to said housing, said steering switch is operationally attached to said transmitter circuit;

a front end hopping switch, said front end hopping switch is operationally attached to said transmitter circuit;

a four wheel lifting switch, said four wheel lifting switch is operationally attached to said transmitter circuit; and an on/off switch attached to said housing, said on/off switch is operationally attached to said transmitter circuit; and a toy car including:

an undercarriage;

a second battery attached to said undercarriage;

a control unit attached to said undercarriage, said control unit operatively connected to said second battery;

a receiver attached to said undercarriage, said receiver is operatively connected to said control unit, wherein said receiver is operationally connectable to said transmitter circuit of said radio transmitter unit;

a motor attached to said undercarriage, said motor is operatively connected to said control unit;

a gear set attached to said undercarriage, said gear set is operatively connected to said control unit, wherein said gear set for propelling and steering said toy car;

a pair of rear axles pivotally attached to said undercarriage;

a pair of front axles pivotally attached to said undercarriage;

a pair of front wheels rotatably attached to said pair of front axles, at least one front wheel of said pair of front wheels is operationally connected to said gear set;

a pair of rear wheels rotatably attached to said pair of rear axles, at least one rear wheel of said pair of rear wheels is operationally connected to said gear set;

a pair of front solenoids attached to said undercarriage and attached to said pair of front axles, said pair of front solenoids is operationally connected to said control unit;

at least one front shock spring attached to said undercarriage and attached to one of said pair of front axles;

a pair of rear solenoids attached to said undercarriage and attached to said pair of rear axles, said pair of rear solenoids is operationally connected to said control unit; and an upper shell attached to said undercarriage wherein said upper shell having at least one seat.

2. The device of claim 1 further comprising four hubcaps attaching said front and rear wheels to said front and rear axles plurality of wheel caps, respectively, each hubcap is releasably attached to said undercarriage of said toy car.

3. The device of claim 1 further comprising a pair of bumpers attached to said undercarriage of said toy car.

4. The device of claim 1 further comprising a cab top detachably attached to said upper shell of said toy car.

5. The device of claim 1 further comprising a toy driver doll.

6. The device of claim 5 wherein said toy driver doll comprising a head; a neck attached to said head; a torso attached to said neck; a pair of arms attached to said torso; and a pair of legs attached to said torso.

7. The device of claim 5 wherein said neck of said toy driver doll comprises a coil spring.

8. The device of claim 5 wherein said torso of said toy driver doll further comprising a lock pin positioned at the bottom of said torso.

9. The device of claim 5 wherein said pair of arms of said toy driver doll is pivotally attached to said torso of said toy driver doll.

10. The device of claim 5 wherein said pair of legs of said toy driver doll is pivotally attached to said torso of said toy driver doll.

11. The device of claim 1 wherein said first battery is rechargeable.

12. The device of claim 1 wherein said second battery is rechargeable.

13. The device of claim 1 wherein said upper shell having an automobile design selected from the group consisting of a 1963 Chevrolet Impala, a 1964 Chevrolet Impala, a 1985 Oldsmobile Cutlass, a 1985 Regal, and a 1983 Cadillac Coupe De' Ville.

14. The device of claim 1 wherein said upper shell is detachably attached to said undercarriage.

15. The device of claim 1 wherein said front end hopping switch is capable of enabling said transmitting circuit to transmit a first radio signal in which said toy car is capable of responding to the transmitted first radio signal by activating said pair of front solenoids to extend lengthwise whereby allowing said undercarriage relative to said pair of front wheels to be elevated into a front end raised position, wherein said front end hopping switch is capable of enabling said transmitting circuit to terminate the transmission of the first radio signal in which said toy car in the front end raised position is capable of responding to the termination of the transmission of the first radio signal by activating said pair of front solenoids to contract lengthwise whereby allowing said undercarriage relative to said pair of front wheels to be lowered, wherein when said undercarriage relative to said pair of front wheels is lowered then said at least one front shock spring is capable of oscillating said undercarriage upwardly and downwardly.

16. The device of claim 1 wherein said four wheel lifting switch is capable of enabling said transmitting circuit to transmit a second radio signal in which said toy car is capable of responding to the transmitted second radio signal by activating said pair of front solenoids and said pair of rear solenoids to extend themselves whereby allowing said undercarriage relative to said pair of front wheels and said pair of rear wheels to be elevated into a four wheel lifted position, wherein said four wheel lifting switch is capable of enabling said transmitting circuit to terminate the transmission of the second radio signal in which said toy car in the four wheel lifted position is capable of responding to the termination of the transmission of the second radio signal by activating said pair of front solenoids and said pair of rear solenoids to distend themselves whereby allowing said undercarriage relative to said pair of front wheels and said pair of rear wheels to be lowered.

17. The device of claim 1 wherein said propulsion switch is capable of enabling said transmitting circuit to transmit a third radio signal in which said toy car is capable of responding to the transmitted third radio signal by activating the gear set to rotationally move at least one wheel of said pair of rear wheels to propel the toy car.

18. The device of claim 1 wherein said steering switch is capable of enabling said transmitting circuit to transmit a fourth radio signal in which said toy car is capable of responding to the transmitted fourth radio signal by activating the gear set to turn at least one wheel of said pair of front wheels to steer the toy car.

19. A remote controllable toy device consisting essentially of:

a radio transmitter unit including:

a housing;

a first battery attached to said housing;

a transmitter circuit attached to said housing, said transmitter circuit is operationally attached to said first battery;

an antenna attached to said housing, said antenna is operationally attached to said transmitter circuit;

a propulsion switch attached to said housing, said propulsion switch is operationally attached to said transmitter circuit;

a steering switch attached to said housing, said steering switch is operationally attached to said transmitter circuit;

a front end hopping switch, said front end hopping switch is operationally attached to said transmitter circuit;

a four wheel lifting switch, said four wheel lifting switch is operationally attached to said transmitter circuit; and an on/off switch attached to said housing, said on/off switch is operationally attached to said transmitter circuit;

a toy car including:

an undercarriage;

a second battery attached to said undercarriage;

a control unit attached to said undercarriage, said control unit operatively connected to said second battery;

a receiver attached to said undercarriage, said receiver is operatively connected to said control unit, wherein said receiver is operationally connectable to said transmitter circuit of said radio transmitter unit;

a motor attached to said undercarriage, said motor is operatively connected to said control unit;

a gear set attached to said undercarriage, said gear set is operatively connected to said control unit, wherein said gear set for propelling and steering said toy car;

a pair of rear axles pivotally attached to said undercarriage;

a pair of front axles pivotally attached to said undercarriage;

a pair of front wheels rotatably attached to said pair of front axles, at least one front wheel of said pair of front wheels is operationally connected to said gear set;

a pair of rear wheels rotatably attached to said pair of rear axles, at least one rear wheel of said pair of rear wheels is operationally connected to said gear set;

a pair of front solenoids attached to said undercarriage and attached to said pair of front axles, said pair of front solenoids is operationally connected to said control unit;

at least one front shock spring attached to said undercarriage and attached to one of said pair of front axles;

a pair of rear solenoids attached to said undercarriage and attached to said pair of rear axles, said pair of rear solenoids is operationally connected to said control unit;

an upper shell attached to said undercarriage wherein said upper shell having at least one seat;

four hubcaps attaching said front and rear wheels to said front and rear axles plurality of wheel caps, each hubcap is releasably attached to said undercarriage of said toy car; and a pair of bumpers attached to said undercarriage of said toy car;

a cab top detachably attached to said upper shell of said toy car; and a toy driver doll including:

a head;

a neck attached to said head wherein said neck of said toy driver doll comprises a coil spring;

a torso attached to said neck;

a pair of arms attached to said torso wherein said pair of arms of said toy driver doll is pivotally attached to said torso of said toy driver doll; and a pair of legs attached to said torso wherein said pair of legs of said toy driver doll is pivotally attached to said torso of said toy driver doll.

20. A method of using a remote controllable toy device, said method comprising the steps of: obtaining the device comprising:

a radio transmitter unit including:

a housing;

a first battery attached to said housing;

a transmitter circuit attached to said housing, said transmitter circuit is operationally attached to said first battery;

an antenna attached to said housing, said antenna is operationally attached to said transmitter circuit;

a propulsion switch attached to said housing, said propulsion switch is operationally attached to said transmitter circuit;

a steering switch attached to said housing, said steering switch is operationally attached to said transmitter circuit;

a front end hopping switch, said front end hopping switch is operationally attached to said transmitter circuit;

a four wheel lifting switch, said four wheel lifting switch is operationally attached to said transmitter circuit; and an on/off switch attached to said housing, said on/off switch is operationally attached to said transmitter circuit;

a toy car including:

an undercarriage having at least one seat;

a second battery attached to said undercarriage;

a control unit attached to said undercarriage, said control unit operatively connected to said second battery;

a receiver attached to said undercarriage, said receiver is operatively connected to said control unit, wherein said receiver is operationally connectable to said transmitter circuit of said radio transmitter unit;

a motor attached to said undercarriage, said motor is operatively connected to said control unit;

a gear set attached to said undercarriage, said gear set is operatively connected to said control unit, wherein said gear set for propelling and steering said toy car;

a pair of rear axles pivotally attached to said undercarriage;

a pair of front axles pivotally attached to said undercarriage;

a pair of front wheels rotatably attached to said pair of front axles, at least one front wheel of said pair of front wheels is operationally connected to said gear set;

a pair of rear wheels rotatably attached to said pair of rear axles, at least one rear wheel of said pair of rear wheels is operationally connected to said gear set;

a pair of front solenoids attached to said undercarriage and attached to said pair of front axles, said pair of front solenoids is operationally connected to said control unit;

at least one front shock spring attached to said undercarriage and attached to one of said pair of front axles;

a pair of rear solenoids attached to said undercarriage and attached to said pair of rear axles, said pair of rear solenoids is operationally connected to said control unit;

an upper shell attached to said undercarriage wherein said upper shell having at least one seat;

four hubcaps attaching said front and rear wheels to said front and rear axles plurality of wheel caps, each hubcap is releasably attached to said undercarriage of said toy car; and a pair of bumpers attached to said undercarriage of said toy car;

a cab top detachably attached to said upper shell of said toy car; and a toy driver doll including:

a head;

a neck attached to said head wherein said neck of said toy driver doll comprises a coil spring;

a torso attached to said neck;

a pair of arms attached to said torso wherein said pair of arms of said toy driver doll is pivotally attached to said torso of said toy driver doll; and a pair of legs attached to said torso wherein said pair of legs of said toy driver doll is pivotally attached to said torso of said toy driver doll;

detaching the cab top from the upper shell of the toy car;

lifting up the cab top from the upper shell of the toy car;

bending the arms and the legs of the toy driver doll to fit within the seat in the toy car;

placing the bent toy driver doll onto the seat in the toy car;

reattaching the cab top onto the upper shell of the toy car;

picking up the radio transmitter unit;

activating the radio transmitter unit by switching on the on/off switch;

pressing onto the front end hopping switch of the radio transmitter unit wherein the toy car elevates to a front end raised position;

depressing onto the front end hopping switch of the radio transmitter unit when the toy car is in the front end raised position wherein enabling the pair of front solenoids to contract lengthwise whereby allowing said undercarriage relative to said pair of front wheels to be lowered, whereby allowing the undercarriage to oscillate upwardly and downwardly;

pushing onto the said four wheel lifting switch of the radio transmitter unit wherein the toy car elevates into a four wheel lifted position;

releasing said four wheel lifting switch of the radio transmitter unit whereby allowing said undercarriage relative to said pair of front wheels and said pair of rear wheels to be lowered;

toggling the propulsion switch of the radio transmitter unit, wherein allowing said toy car to be propelled forward relative to the pair of front axles;

touching the propulsion switch of the radio transmitter unit, wherein allowing said toy car to be propelled backwards relative to the pair of front axles; and manipulating the steering switch of the radio transmitter unit, wherein allowing said toy car to be turned.

* * * * *